US006203668B1

(12) United States Patent
Koivukunnas et al.

(10) Patent No.: US 6,203,668 B1
(45) Date of Patent: Mar. 20, 2001

(54) DEVICE FOR FASTENING A ROLL TO A FRAME OF A PAPER MACHINE

(75) Inventors: Pekka Koivukunnas, Järvenpää; Raimo Immonen, Vantaa, both of (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 08/320,439

(22) Filed: Oct. 7, 1994

(30) Foreign Application Priority Data

Oct. 12, 1993 (FI) ..... 934499

(51) Int. Cl.[7] ..... B23P 15/00

(52) U.S. Cl. ..... 162/272; 241/285.1; 248/223.41; 162/273; 492/47

(58) Field of Search ..... 29/434, 436, 525.02, 29/525.03, 700; 241/101.2, 285.1; 403/335, 360, 361, 381, 405.1, 406.1, 407.1, 408.1, DIG. 4; 162/272, 273; 248/223.41, 680; 100/170; 72/238; 492/47

(56) References Cited

U.S. PATENT DOCUMENTS 2,379,752 * 7/1945 Schultz ..... 403/408.1 X
3,840,192 * 10/1974 Hendrickson ..... 29/525.02 X
4,770,382 9/1988 Lehti ..... 248/181
5,193,262 * 3/1993 Hyde et al. ..... 29/525.02 X

FOREIGN PATENT DOCUMENTS 2535039 2/1977 (DE) .
77105 1/1988 (FI) .
527541 * 5/1976 (RU) ..... 403/405.1

* cited by examiner

*Primary Examiner*—Irene Cuda
(74) *Attorney, Agent, or Firm*—Steinberg & Raskin, P.C.

(57) ABSTRACT

A device for fastening a roll to the frame construction in a paper machine, paper finishing machine, or equivalent, wherein the ends of the roll are provided with bearings. The bearing housings of the bearings, or fastening bases formed onto the bearing housings, are mounted against a back-up face formed on the frame construction so as to position the roll in its place on the machine frame. On the machine frame, fastening members are arranged to be displaceable in a direction substantially perpendicular to and against the back-up face formed on the frame construction and include flange portions, i.e., shoulders or equivalent formed pieces. Correspondingly, the bearing housings, or fastening bases arranged thereon, are provided with grooves corresponding to the shape of the flange portions of the fastening members. When the roll is installed in its place, the flange portions pass into the grooves in the bearing housings. Then, the fastening members tighten the bearing housings or the fastening bases, respectively, forcibly against the back-up faces on the frame construction.

16 Claims, 8 Drawing Sheets

DEVICE FOR FASTENING A ROLL TO A FRAME OF A PAPER MACHINE

BACKGROUND OF THE INVENTION

The present invention relates to a device for fastening a roll to a frame construction in a paper machine, paper finishing machine, or equivalent, wherein the ends of the roll are provided with bearings housings. The bearing housings, or fastening bases that have been formed onto the bearing housings, are mounted against a back-up face formed on the frame construction so as to position the roll in its place on the machine frame. A method for fastening the roll to the machine frame is also disclosed.

In certain parts of paper machines, board machines and equivalent and/or of paper and board finishing machines, quick replacement of rolls is required in order that unduly long standstills could be avoided. Quick replacement of rolls is a particularly important property in soft calenders, in which, out of the rolls that form the calendaring nip, the soft faced roll must be replaced from time to time and quite frequently for conditioning. However, in conventional frame constructions, the opening of the fastening screws and, on the other hand, the tightening of the screws to the correct tightening torque, constitute quite a laborious and time-consuming working step. The fastening screws are placed in very awkward locations, for example high above the floor plane, far from tending platforms, in narrow gaps, and close to hot roll faces. Also, tightening of the screws to the correct torque requires a high force whose generation under the circumstances referred to above is difficult and even dangerous.

Owing to the drawbacks mentioned above, in the prior art, attempts have also been made to develop various fastening arrangements in which the roll is fastened to the frame construction without screws by means of particular fastening members. However, for the most part, these fastening arrangements have involved a number of considerable drawbacks, such as complicated fastening arrangement and unreliability of the fastening, for which reason such fastening arrangements in machine constructions in operation have been very rare. Moreover, it has not been possible to apply any of such fastening arrangements to a soft calender.

OBJECTS AND SUMMARY OF THE INVENTION

Accordingly, it is an object of the present invention to provide a device and method for fastening a roll to the frame construction by means of which the above drawbacks involved in the prior art are avoided.

It is another object of the present invention to provide a new and improved device and method for fastening a roll to the frame construction by means of which the fastening and detaching of the roll can be carried out easily and rapidly.

In view of achieving these objects and others, in accordance with the invention, fastening members are arranged on the frame of the machine and can be displaced forcibly substantially in a direction perpendicular against the back-up face formed on the frame construction. The fastening members are provided with a flange portion, i.e., shoulders or with equivalent formed pieces, whereby by providing bearing housings or the fastening bases fitted on the bearing housings with at least one groove corresponding to the shape of the flange portions of the fastening members, a secure fastening is attained. In this manner, when the roll is installed in its operating position, the flange portions are arranged to pass into the at least one grooves in the bearing housings, and the fastening members are arranged to tighten the bearing housings or the fastening bases, respectively, forcibly against the back-up faces on the frame construction. Preferably, the bearing housings or fastening bases formed thereon have two grooves so that there are two fastening members having a flange portion which are situated on each side of the roll.

By means of the invention, compared with the prior art, a number of advantages are obtained, of which some of the most important ones are security and reliability of operation of the fastening device. By means of the device in accordance with the invention, the roll also remains in its position in the event of any disturbances. The invention can be applied most advantageously so that, when the device in accordance with the invention is used, the roll is attachable to the frame construction and detachable from the same completely untouched by hand, i.e., by the intermediate of the control desk. Manual operation is, however, also fully possible if desired.

In the method for fastening a roll to a frame of a paper machine, paper finishing machine, or equivalent, in accordance with the invention, the ends of the roll are provided with bearings and fastening members having a flange portions, i.e., shoulders or formed pieces, are arranged on the machine frame. The roll bearings are mounted in respective bearing housings arranged against back-up faces of the machine frame. To fasten the roll, the bearing housings are displaced into connection with the machine frame such that at least one groove in the bearing housing receives a respective one of the flange portions of the fastening members, and the fastening members are then displaced in a direction substantially perpendicular to the back-up faces to tighten the bearing housings against a respective back-up face. The bearing housings can be displaced in a direction parallel to a respective one of the back-up faces in conjunction with the displacement of the fastening members to tighten the bearing housings against the back-up faces. Further, the displacement of the fastening members can be controlled by remote-control via a control desk.

Further advantages and characteristic features of the invention come out from the following detailed description of the invention.

In the following, the invention will be described in detail with reference to some exemplifying embodiments of the invention illustrated schematically in the figures in the accompanying drawings. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
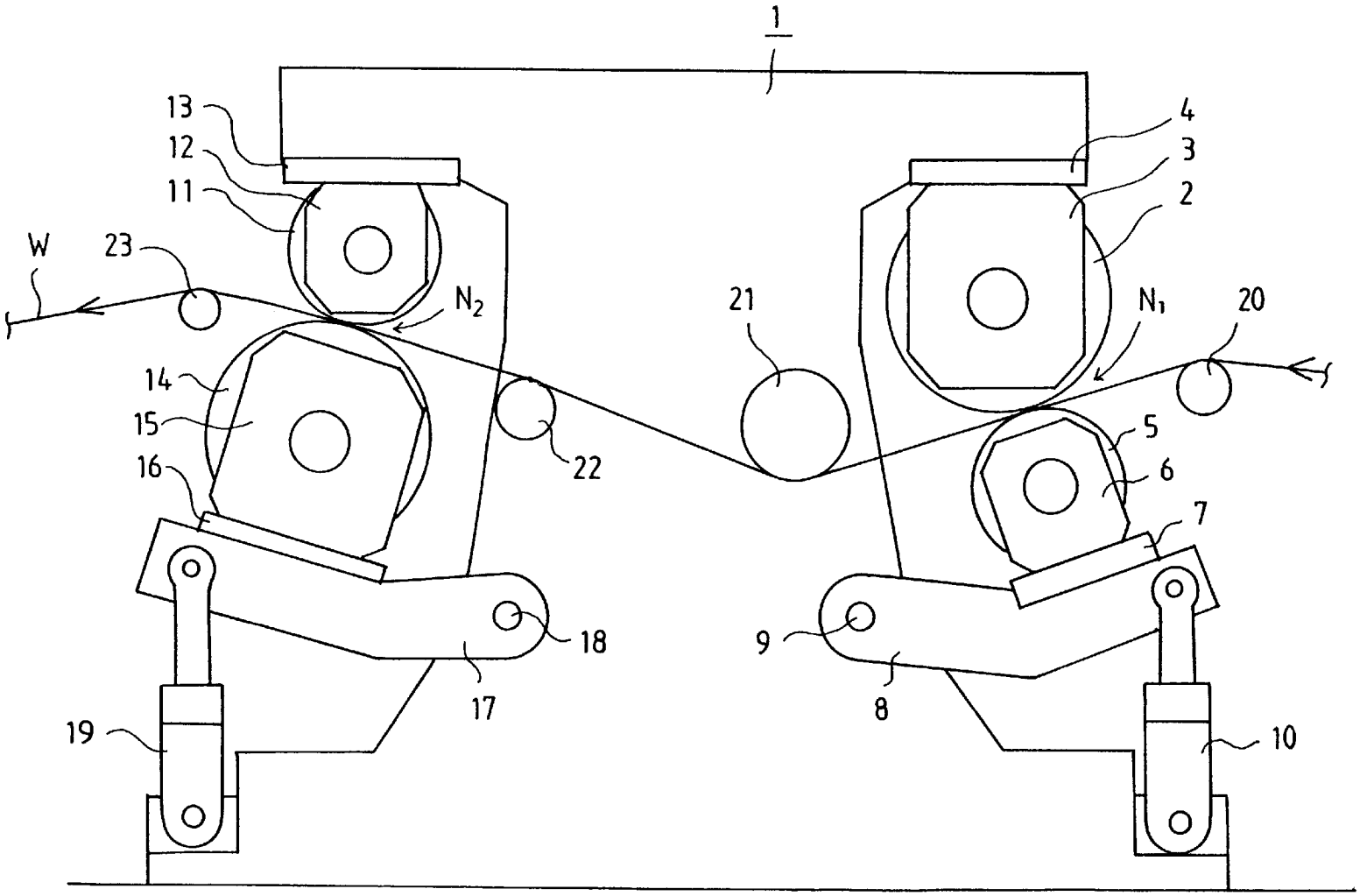
FIG. 1 is a fully schematic side view of a two-nip soft calender to which the device and method in accordance with the invention are applied.

Referring to the accompanying drawings wherein the same reference numerals refer to the same elements, FIG. 1 is a schematic illustration of a two-nip $N_1$,$N_2$ soft calender, which is primarily utilized for two-sided calendaring of a paper web W. The calendaring nips $N_1$ and $N_2$ are formed between a heatable, hard roll and a soft-faced roll. Of the rolls of the first nip $N_1$, upper roll 2 is a hard-faced heatable roll, and bearing housing 3 of this roll is rigidly fixed by the intermediate of a fastening base 4 directly to a frame 1 of the calender. Lower roll 5 of the first nip $N_1$ is a soft-faced roll, and bearing housing 6 of this soft-faced roll 5 is attached by the intermediate of a fastening base 7 to a loading arm 8. Loading arm 8 is pivotally linked with the calender frame 1 by means of an articulation shaft 9 oriented transverse to the machine direction. Between the loading arm 8 and the calender frame 1, a loading cylinder 10 is mounted for loading the nip $N_1$ and for opening the nip when desired.

Of the rolls of the second nip $N_2$, upper roll 11 is a soft-faced roll, whose bearing housing 12 is fixed, by the intermediate of a fastening base 13, directly and rigidly to the frame 1 of the calender. In a corresponding manner, lower roll 14 of the nip $N_2$ is a heatable, hard-faced roll, whose bearing housing 15 is fixed to a loading arm 17 by the intermediate of a fastening base 16. Loading arm 17 is pivotally linked with the calender frame 1 by means of an articulation shaft 18 oriented transverse to the machine direction. Between the loading arm 17 and the calender frame 1, a loading cylinder 19 is mounted for loading the second nip $N_2$ is loaded and for opening the nip when desired. While being guided by alignment, reversing and spreader rolls 20,21,22,23 arranged in proximity to the nips, a paper web W is guided and passed through both nips $N_1$,$N_2$ of the calender so that one side of the paper web is calendared in the first nip $N_1$ of the calender, and the opposite side of the paper web is calendared in the second nip $N_2$.

Figure 2:
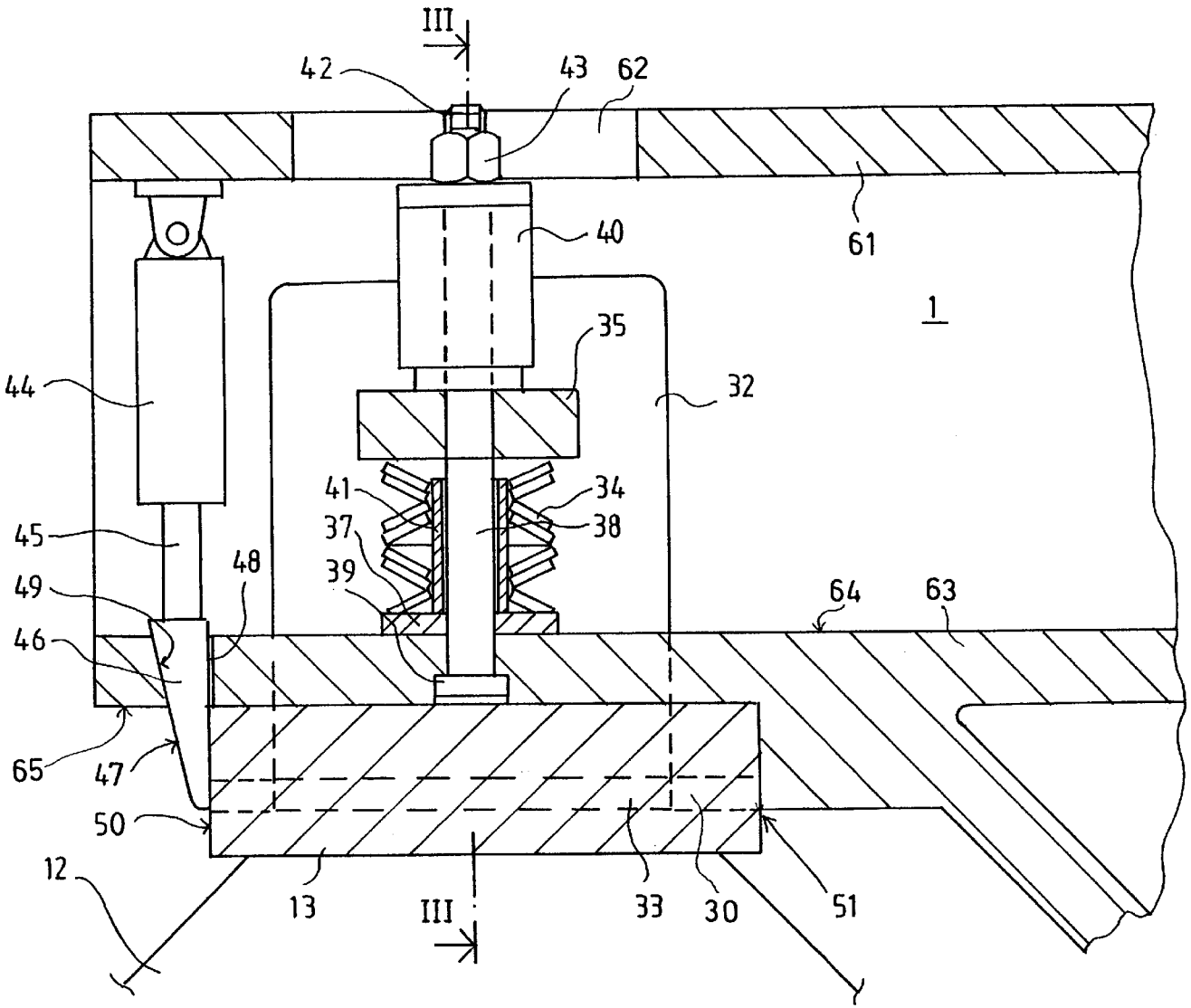
FIG. 2 is an enlarged sectional view of the fastening arrangement of the soft roll placed in the upper position in the second nip of the soft calender shown in FIG. 1, in which fastening arrangement the device and method in accordance with the invention are applied.
Figure 3:
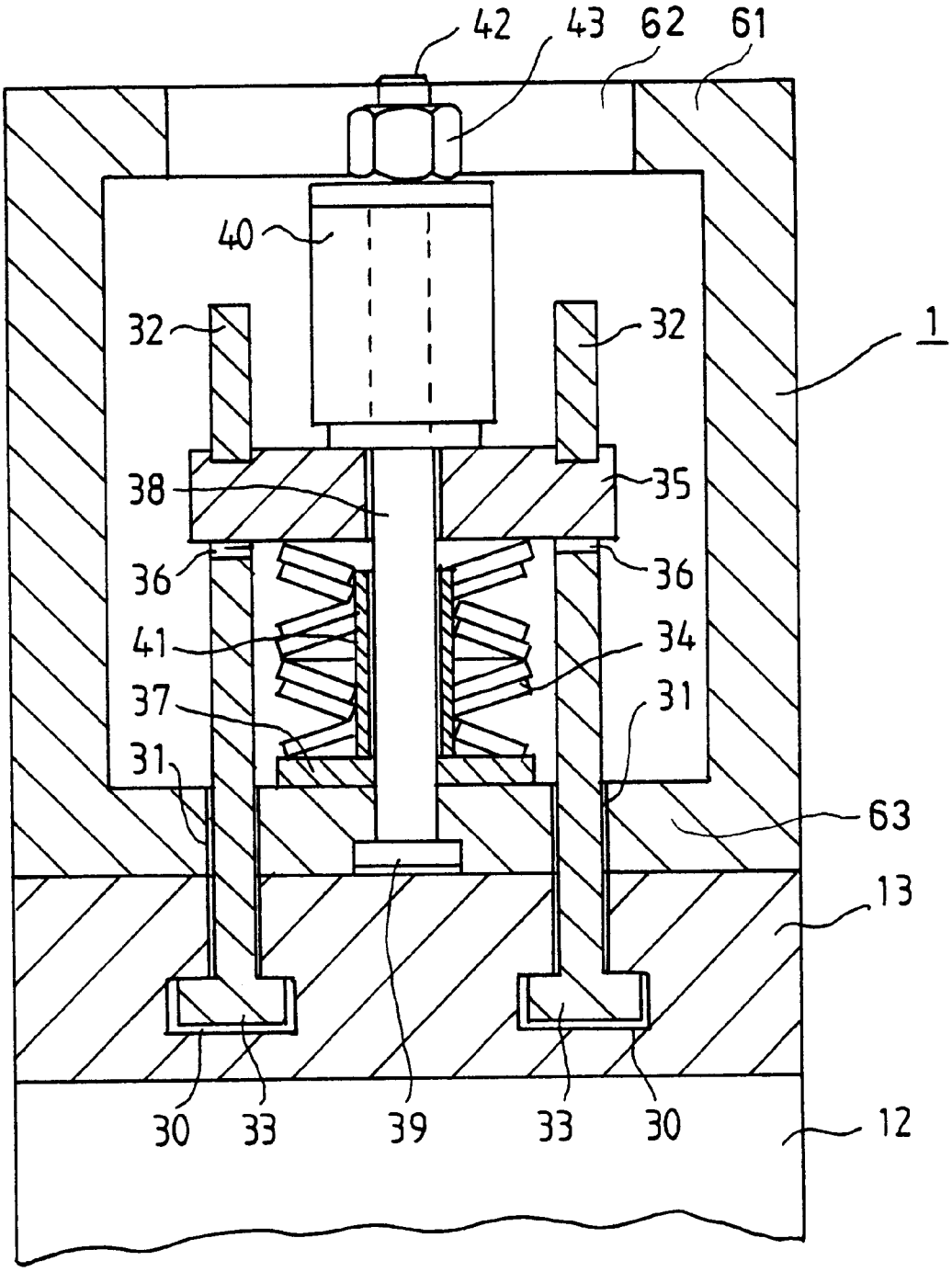
FIG. 3 is a schematic sectional view along the line III—III in FIG. 2.

FIGS. 2 and 3 are enlarged sectional views that illustrate the fastening arrangement of the upper roll of the second nip $N_2$ in a soft calender as shown in FIG. 1, in which arrangement the device and method in accordance with the invention can be applied for fastening the roll to the frame construction. FIG. 2 is a sectional view of the fastening arrangement taken in the vertical plane in the longitudinal direction of the machine, and, in a corresponding manner, FIG. 3 is a sectional view taken along the line III—III in FIG. 2. In the embodiment shown in FIGS. 2 and 3, the bearing housing 12 of the roll is provided with the fastening base 13, by whose means the bearing housing 12 is fixed to the frame 1 of the soft calender. In the area of the fastening point of the bearing housing 12, the frame construction 1 of the soft calender consists of a box beam construction, which comprises an upper wall 61, a lower wall 63, and side walls (FIG. 3). Onto the lower face of the lower wall 63, a back-up face 65 is machined, against which the fastening base 13 of the bearing housing is fixed.

In the embodiment shown in FIGS. 2 and 3, backed-off grooves 30 are formed into the fastening base 13, which run in the longitudinal direction of the machine, i.e. perpendicularly to the roll axle, and which are T-section grooves in the embodiment of FIGS. 2 and 3. Only one groove is necessary; however, two grooves is the preferred embodiment. Other sectional forms of the grooves 30 may also be utilized. As shown in FIGS. 2 and 3, the T-section grooves 30 are open toward the back-up face 65 formed on the frame, and further, in the embodiment of FIGS. 2 and 3, the T-section grooves 30 extend in the longitudinal direction of the machine preferably across the entire length of the fastening base 13. Fastening members 32, having a flange portion corresponding to the shape of the grooves 30, are arranged in the frame 1 of the calender. These members are displaceable in a perpendicular direction in relation to the back-up face 65.

As shown in FIGS. 2 and 3, the fastening members 32 are plate-shaped so that their bottom end is provided with a T-section part or flange portion 33, which penetrates into the T-section grooves in the fastening base 13. Regardless of the form of the grooves 30 and the part 33, these elements should ideally have a corresponding shape. Openings 31 are formed in the lower wall 63 of the box beam that forms the frame 1 of the calender. Through the openings 31, the fastening members 32 penetrate through the lower wall 63 into the interior of the box beam.

Further, the fastening arrangement in accordance with the invention includes an elongate vertical shaft 38 having a first, lower end in contact with the frame 1 of the calender. Specifically, the shaft 38 has a flange 39 engaging with a surface of the fastening base 13. In the exemplifying embodiment, a through hole is formed in the lower wall 63 of the box beam of the frame 1, and through which hole, the shaft 38 is passed to extend into the box beam. The flange 39 of the shaft prevents upward movement of the shaft 38 since the size of the flange 39 is larger than the hole through which the shaft 38 passes. On the shaft 38, a washer 37 is passed against an upper face 64 of the lower wall 63, and further a bushing 41 is passed around the shaft 38 and into engagement with the washer 37. An assembly of cup springs 34 is arranged on the bushing 41. The axial extension of the assembly is larger than the axial length of the bushing 41. A horizontal plate 35 is arranged on the spring assembly 34 such that the shaft 38 penetrates through an aperture in the plate 35. A hollow cylinder 40 is arranged on the plate 35 and has an axial hole through which the shaft 38 extends. The top end of the shaft 38 is provided with a threaded portion 42 onto which a nut 43 is threaded against the upper end of the hollow cylinder 40. The horizontal plate 35 extends through openings 36 formed in the fastening members 32 so that the fastening members 32 are suspended on the plate 35.

The fastening arrangement also includes a locating device, i.e., positioning means, which is illustrated in more detail in FIG. 2. The locating device comprises a cylinder 44 fixed to the inner face of the upper wall 61 of the box beam. A wedge piece 46 is fixed to the piston rod 45 of the cylinder 44, and, correspondingly, an opening 48 is formed for the wedge piece 46 in the lower wall 63 of the frame construction 1. The wedge piece 46 penetrates in the manner shown in FIG. 2 through an opening 48 when the piston of the cylinder 44 is in its projecting or extending position. The wedge piece 46 is shaped so that the face of the wedge that is placed toward the fastening base 13 of the bearing housing 12 is substantially straight, i.e., parallel to the piston rod 45. An opposite side face 47 of the wedge piece 46, i.e., the face that is placed facing away from the fastening base 13, is shaped oblique or inclined in relation to the direction of movement of the cylinder 44 piston. Correspondingly, one side of the opening 48 is shaped inclined so that the inclination of the side 49 is substantially similar to the inclined face 47 of the wedge piece 46.

The operation and the use of the fastening arrangement during installation of a roll and during removal of same, respectively, are as follows. As comes out from FIGS. 2 and 3, the spring assembly 34 loads the fastening members 32 upward with a certain force. The pre-tightening of the spring assembly 34 is carried out by means of the nut 43, and the rigidity of the spring assembly 34 and the pre-tightening produced by means of the nut 43 are selected and arranged such that the spring force of the spring assembly 34 is sufficiently high in relation to the weight of the roll to be fastened, with all of its accessories. A suitable spring force is, for example, from about 3 to about times as high as the weight of the roll. Owing to the construction shown in FIGS. 2 and 3, an opening 62 is formed in the upper wall 61 of the box beam of the frame construction 1, through which opening, e.g., the pre-tightening can be adjusted. Once the pre-tightening has been adjusted correctly, the nut 43 does not need to be rotated further. Thus, during removal and installation of rolls, the pre-tightening need not be re-adjusted separately every time.

When a roll is installed in its position by means of the fastening arrangement in accordance with the invention, first the piston of the cylinder 44 is pulled in so that the wedge piece 46 does not interfere with the installation of the bearing housing. By means of the cylinder 40, i.e., by introducing a pressure fluid through a connection 44A into a pressure chamber 43A defined between an annular shaped frame portion of the cylinder 40 and a movable annular piston 42A therein which actuates against plate 35, the spring assembly 34 is pressed together so that the fastening members 32 are shifted downward into a position in which the fastening base 13 can be installed in its position. After this, the roll is transferred, e.g., by means of a crane into a suitable position, and it is shifted further horizontally and in the longitudinal direction of the machine so that the T-section pieces 33 of the fastening members 32 fit into the T-section grooves 30 in the fastening base 13. The shifting of the roll is continued until the end of the fastening base meets the back-up face 51 formed onto the frame construction 1. Thereafter, the pressure in the hollow cylinder 40 is reduced so that the force of the spring assembly 34 pulls the bearing housings 12 of the roll upward, whereby the upper face of the fastening base reaches contact with the horizontal back-up face 65 formed on the frame construction. At this stage, the pressure in the hollow cylinder 40 should, however, not be released completely.

After the fastening base 13 is arranged in its place in this manner, it is located in its ultimate position by means of the wedge piece 46 operated by means of the cylinder 44. The piston rod 45 of the cylinder 44 is pushed outward, whereby the inclined face 47 of the wedge piece 46 meets the inclined face 49 of the opening 48. In this manner, while being guided by these inclined faces 47,49, the wedge piece 47 is shifted downward and reaches contact with the end face 50 of the fastening base 13. When the wedge piece 47 is shifted down further, the fastening base 13 is positioned precisely against the back-up face 51. After this, the pressure can then be released ultimately out of the hollow cylinder 40, in which case the bearing housing 12 is in its proper operating place in the desired position by the intermediate of the fastening base 13 while supported by the fastening members 32.

When the roll is removed, of course, the procedure is reversed, so that first the wedge piece 46 is pulled out and up by means of the cylinder 44, after which the hollow cylinder 40 is pressurized, and the roll can be shifted away from its place by means of a crane in the machine direction. The cylinder 44 of the locating device and the cylinder 40 that compresses the spring assembly 34 can be operated under remote control from a control desk, so that, in the arrangement of the invention, the replacement of rolls is significantly quicker and simpler, in comparison with the prior art.

Figure 4:
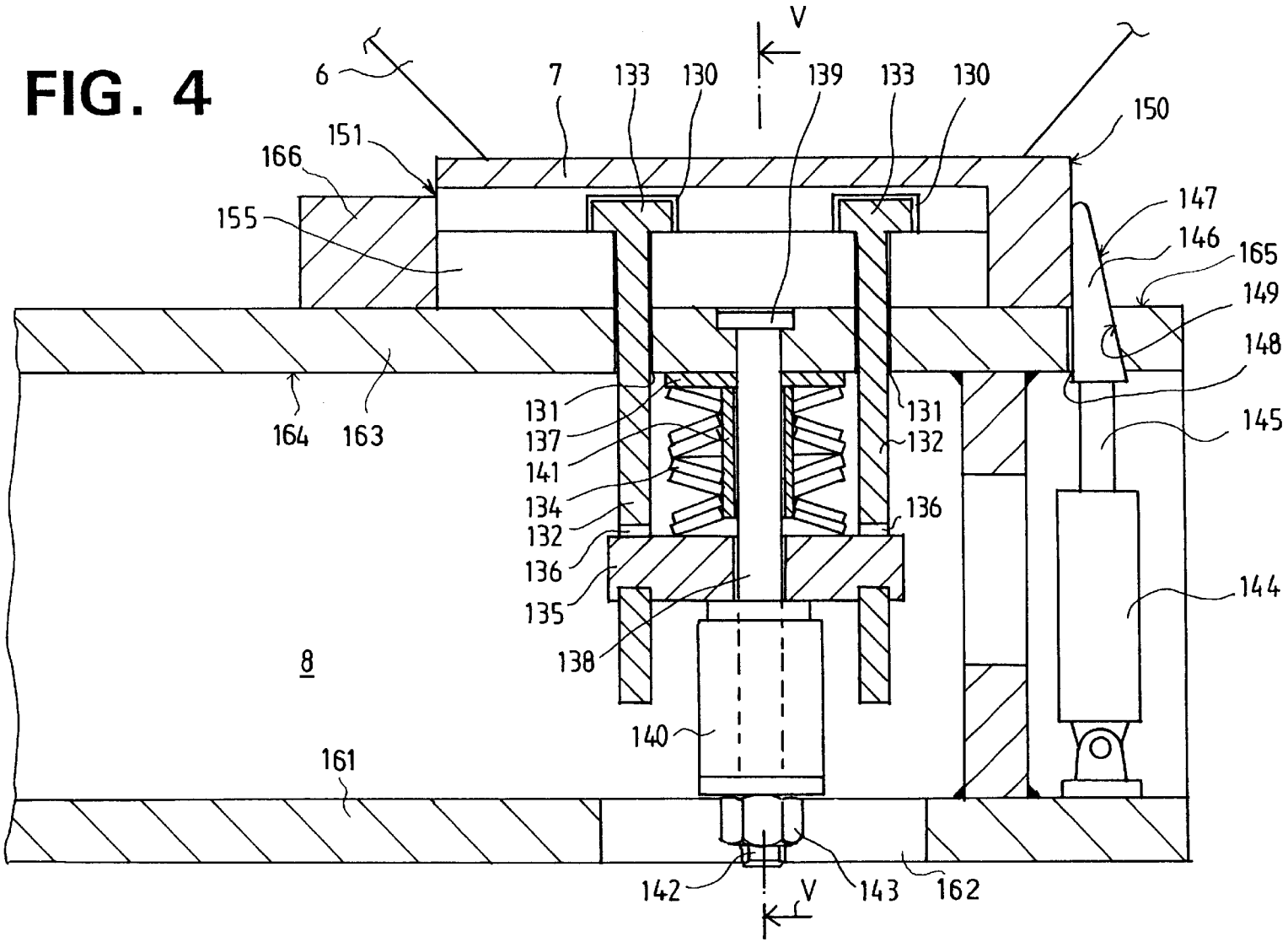
FIG. 4 is an enlarged schematic sectional view of the fastening arrangement of the soft roll placed in the lower position in the first nip of the soft calender shown in FIG. 1, in which arrangement the device and method in accordance with the invention are applied.
Figure 5:
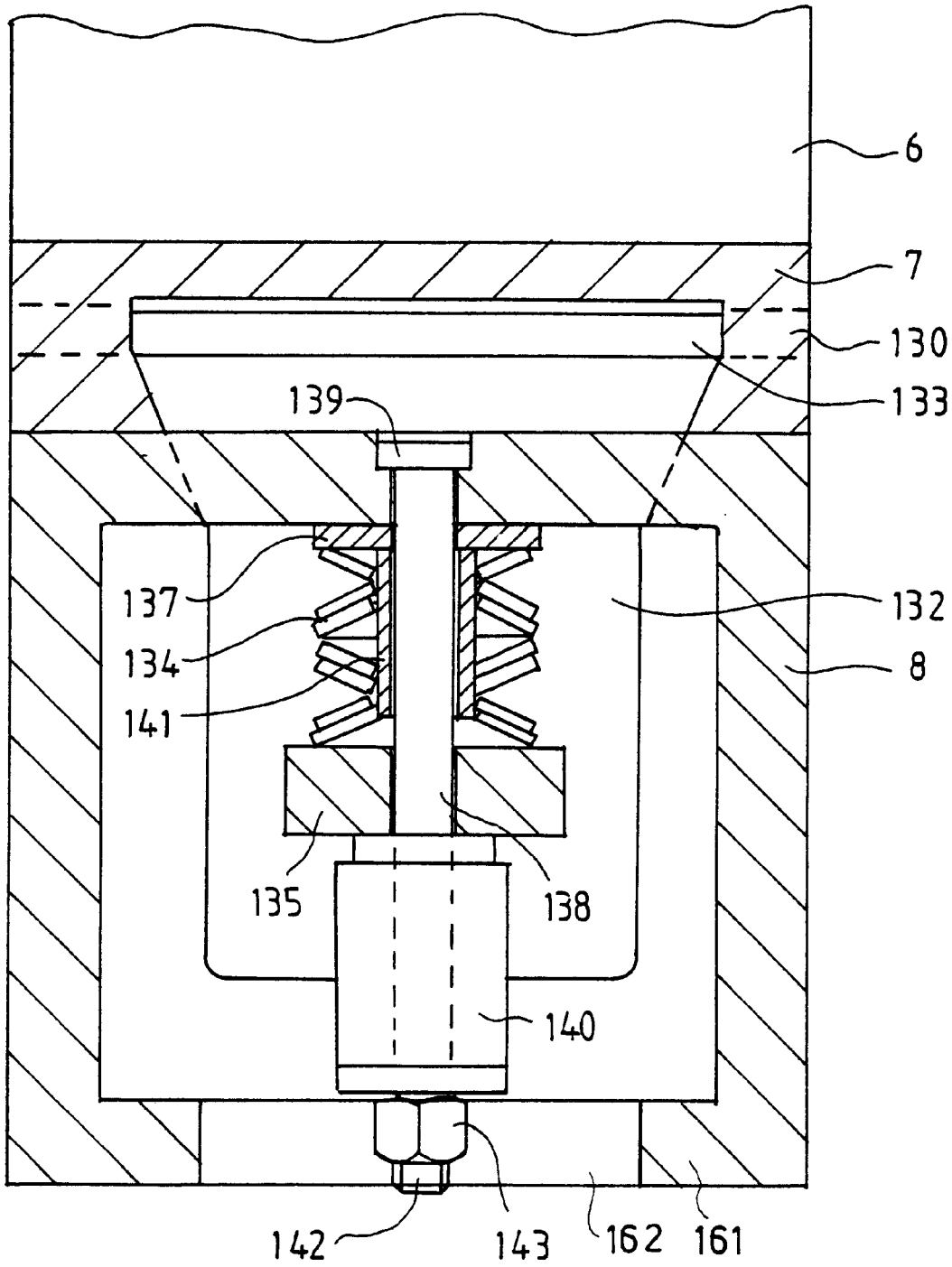
FIG. 5 is a schematic sectional view taken along the line V—V in FIG. 4.
Figure 6:
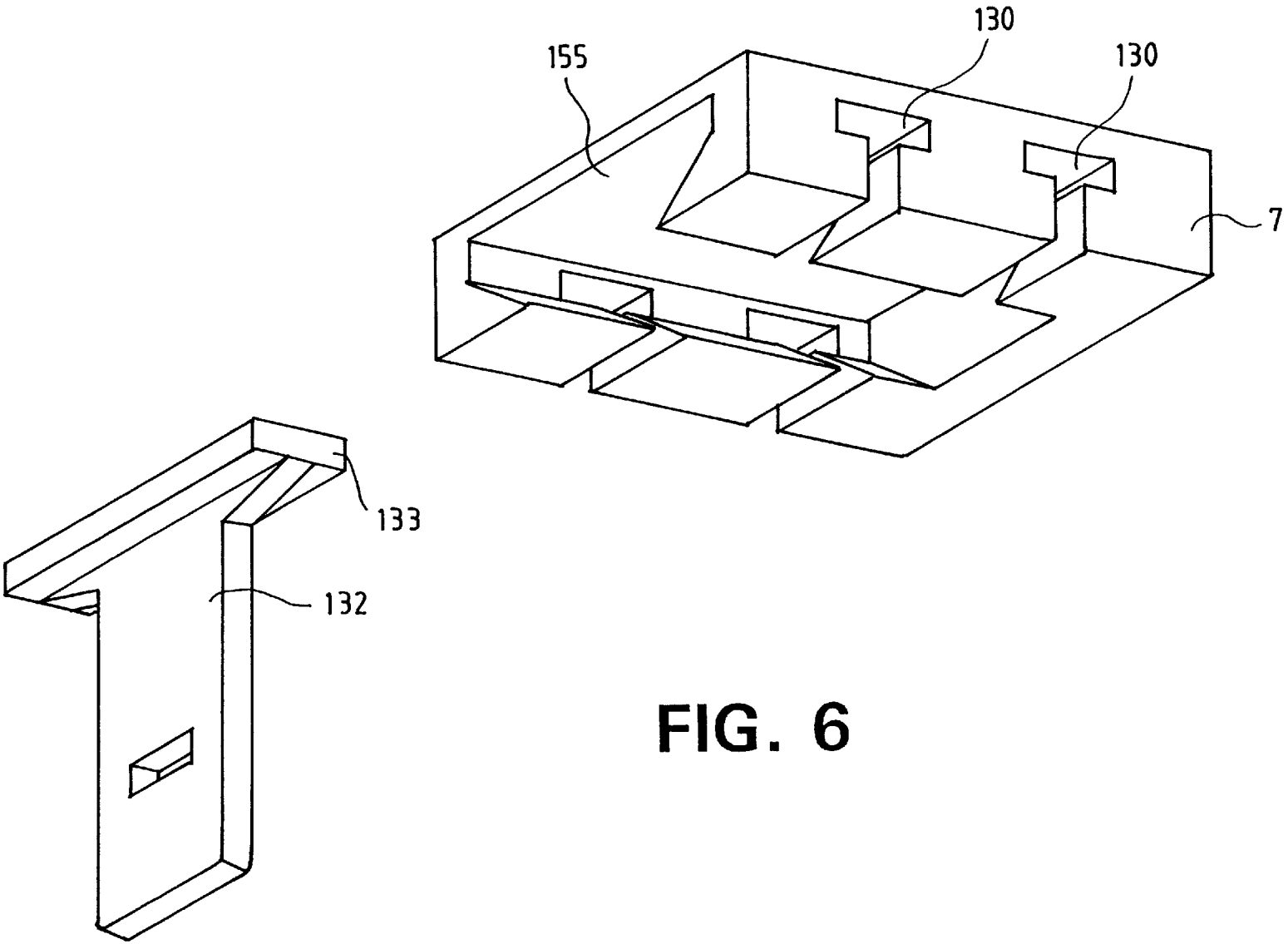
FIG. 6 is a schematic perspective view that illustrates the fastening base and the fastening member belonging to the fastening device as shown in FIGS. 4 and 5.

FIGS. 4 and 5 are schematic sectional views of the application of the fastening arrangement in accordance with the invention to the fastening of the roll 5 placed in the lower position in the first nip $N_1$ in the calender as shown in FIG. 1. FIG. 4 is a sectional view of the roll fastening system taken in the vertical plane in the machine direction, and FIG. 5 is a sectional view taken along the line V—V in FIG. 4. Further, FIG. 6 is a schematic perspective view of the fastening base and the fastening member used in the fastening as shown in FIGS. 4 and 5. With regards to its principal structure, the fastening arrangement of FIGS. 4 and 5 is substantially similar to the system shown in FIGS. 2 and 3, but is just inverted "upside down". Thus, in the embodiment of FIGS. 4 and 5, the fastening base 7 which belongs to the bearing housing 6 of the roll 5 is mounted on the loading arm 8 on a back-up face 165 formed on the loading arm.

In the exemplifying embodiment of FIGS. 4 and 5, the loading arm 8 consists of a box beam construction, which comprises a lower wall 161, an upper wall 163, and side walls (FIG. 5). The fastening system arranged inside the box beam construction is substantially similar to the arrangement described in relation to FIGS. 2 and 3, and, thus, the fastening system includes a shaft 138, which is arranged in a hole formed in the upper wall 163 of the box beam construction, having a flange 139 couple thereto or formed in connection therewith. The flange 139 prevents the shaft 138 from moving in a downward direction in the illustrations in FIGS. 4 and 5. Inside the box beam construction, against a lower face 164 of the upper wall 163, a washer 137 is placed on the shaft 138. Further, a bushing 141 is arranged on the shaft 138, and on this bushing, a spring assembly 134 consisting of cup springs is mounted. Underneath the spring assembly 134, a transverse plate 135 is mounted having an aperture through which the shaft 138 passes. At the opposite side of the plate 135, a hollow cylinder 140 is mounted which comprises an axial through hole through which the shaft 138 extends. Further, a threaded portion 142 is formed on the shaft 138 and a nut 143 is threaded onto the threaded portion 142 to hold the entire construction together.

Further, the fastening arrangement includes fastening members 132, which are plate-shaped pieces and to whose end a T-section piece (flange portion) 133 has been formed in a manner similar to that shown in FIGS. 2 and 3. In the upper wall 163 of the box beam construction, openings 131 are formed through which the fastening members 132 penetrate. Further, in the fastening members 132, openings 136 are formed through which the transverse plate 135 arranged on the shaft 138 is passed so that the fastening members 132 are suspended on the transverse plate 135. In a way similar to the exemplifying embodiment shown in FIGS. 2 and 3, into the fastening base 7, T-section grooves 130 corresponding to the shape of the T-section pieces 133 of the fastening members 132 are formed. Into the grooves 103, the fastening members 132 are arranged in the way illustrated in FIGS. 4 and 5. In this respect, the embodiment of FIGS. 4 and 5 differs from the embodiment shown in FIGS. 2 and 3 so that the T-section grooves 130 formed into the fastening base 7 are placed in the transverse direction of the machine. In this case, the fastening members 132 are thus installed in a corresponding manner. For this reason, the bearing housing 6 and the fastening base 7 must be installed in their positions by shifting in the transverse direction of the machine, and not in the machine direction, which is the case in the embodiment of FIGS. 2 and 3.

However, as is illustrated particularly clearly in FIG. 6, in the fastening base 7, a backed-off groove 155 extending in the machine direction is also formed for the fastening members 132. Thus, the fastening members 132 are shaped in a corresponding way so that the shape of the T-section pieces 133 of the fastening members 132 corresponds to the shape of the backed-off groove 155 placed in the machine direction. As such, the extension of the T-section pieces 133 in the transverse direction of the machine is, in a way corresponding to the shape of the groove 155, larger than the extension of the plate-like part of the fastening members 132. This construction permits installation of the bearing housings 6 and the fastening bases 7 also in the machine direction, as in the embodiment shown in FIGS. 2 and 3.

Further, the fastening arrangement includes a locating device, which comprises an elongate cylinder 144 fixed at one end to the lower wall 161 of the box beam construction. At an opposed end of the cylinder 144, a piston rod 145 of the cylinder is connected to a wedge piece 146 having a face placed facing toward the fastening base 7 which is substantially parallel to the movement of the piston rod 145. An opposite face 147 of the wedge piece 146 is inclined and wedge-shaped. For the wedge piece 146, an opening 148 is formed in the upper wall 163 of the box beam construction, which opening is shaped similarly to the shape of the wedge piece 146 so that the side of the opening 148 that is placed at the side of the fastening base 7 is straight, and the opposite side, i.e. the side 149 that is placed facing away from the fastening base 7, is inclined and forms a back-up face for the inclined face 147 of the wedge piece 146.

In the embodiment of FIGS. 4, 5 and 6, the installation of the roll is carried out as follows. First, by means of the nut 143, the spring assembly 134 is tightened to the desired pre-tightening level, and by means of the cylinder 140, the spring assembly 134 is pressed together, whereby the fastening members 132 are pushed to their upper position. Owing to the construction shown in FIGS. 4 and 5, an opening 162 is formed in the upper wall 161 of the box beam 8 of the frame construction, through which opening, e.g., the pre-tightening can be adjusted. As described above, the adjustment of the pre-tightening is carried out just once, and after this, the pre-tightening is not interfered with during replacement of rolls. For the installation of the bearing housing 6 into its position, the piston of the cylinder 144 of the locating device has, of course, been pulled into the cylinder, so that the wedge piece 146 does not interfere with the installation of the fastening base 7. After this, the roll is installed in its position, and this can be performed in two alternative ways.

First, the roll can be installed into its position so that is shifted into its position in the axial direction of the roll, i.e. in the transverse direction of the machine, in which case the T-section grooves 130 in the fastening base 7 meet the T-section pieces 133 of the fastening members 132. The roll is shifted in the transverse direction until it is in the desired position, after which some of the pressure can be released from the cylinder 140. After this, the piston rod 145 of the cylinder 144 of the locating device is pushed outward so that the inclined face 147 of the wedge piece 146 glides against the similarly inclined side 149 of the opening 148. In this manner, the opposite face of the wedge piece 146 meets a back-up face 150 of the fastening base 7 and forces the fastening base 7 to move along the plane face 165 so that the fastening base 7 is placed against a precisely machined back-up face 151 of a back-up piece 166 arranged in the box beam construction. When the fastening base 7 is in tight contact with the back-up face 151, the pressure in the cylinder 140 can be released completely, in which case the spring assembly 134 pulls the fastening members 132 down in the illustrations of FIGS. 4 and 5 and tightens the fastening base 7 tightly into its position in the desired location. Removal of the roll 5 out of its place is carried out by performing the operations described above in the reverse sequence.

In the exemplifying embodiment of FIGS. 4, 5 and 6, the roll 5 can also be installed into its position in an alterative way. Since, in this exemplifying embodiment, a backed-off groove 155 that extends in the machine direction is also formed in the fastening base 7, the roll can be installed into its position by shifting it in the machine direction. Then, the installation of the roll into its position is carried out so that first, by operating the cylinder 140, the fastening members 132 are shifted to their upper position. At this stage, the cylinder 144 of the locating device is, of course, in the retracted position. Then, the roll 5 can be installed into its position by shifting it in the machine direction so that the T-section pieces 133 on the fastening members 132 meet the backed-off groove 155, the roll 5 being shifted in the machine direction far enough until the side of the fastening base 7 meets the back-up face 151. After this, some of the pressure in the cylinder 140 can be released and, by operating the cylinder 144 of the locating device, the fastening base 7 is shifted ultimately to its correct position so that the fastening base 7 is placed tightly against the back-up face 151. Thereafter, the pressure can be released completely from the cylinder 140, whereby the roll is in its desired position. Thus, in the embodiment of FIGS. 4, 5 and 6, the roll can be replaced either by using a crane or by using a roll replacement carriage.

Figure 7:
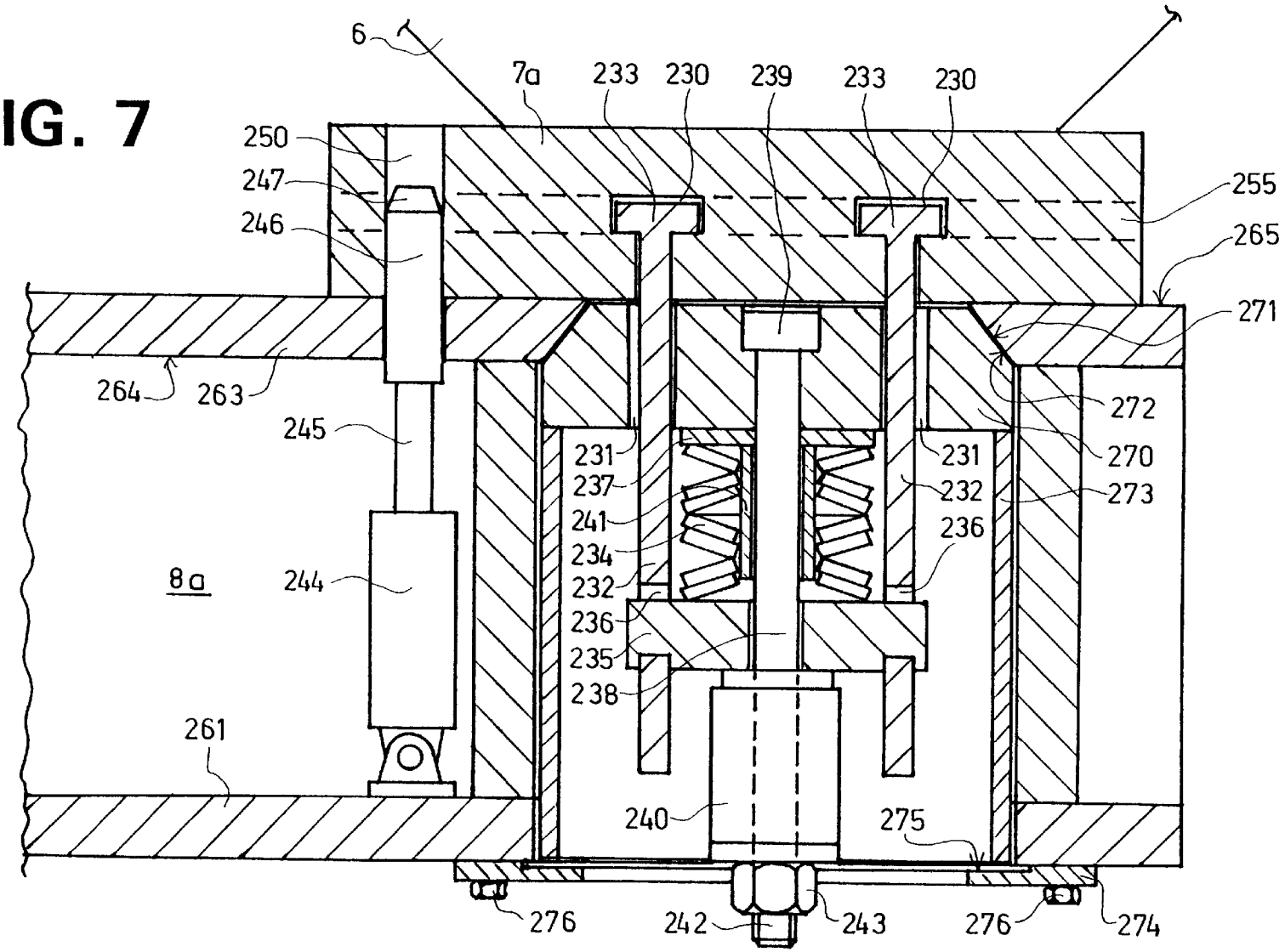
FIG. 7 is an alternative embodiment to that of FIG. 4 showing enlarged schematic sectional view of the fastening arrangement of the soft roll placed in the lower position in the first nip of the soft calender shown in FIG. 1, in which arrangement the device and method in accordance with the invention are applied.
Figure 8:
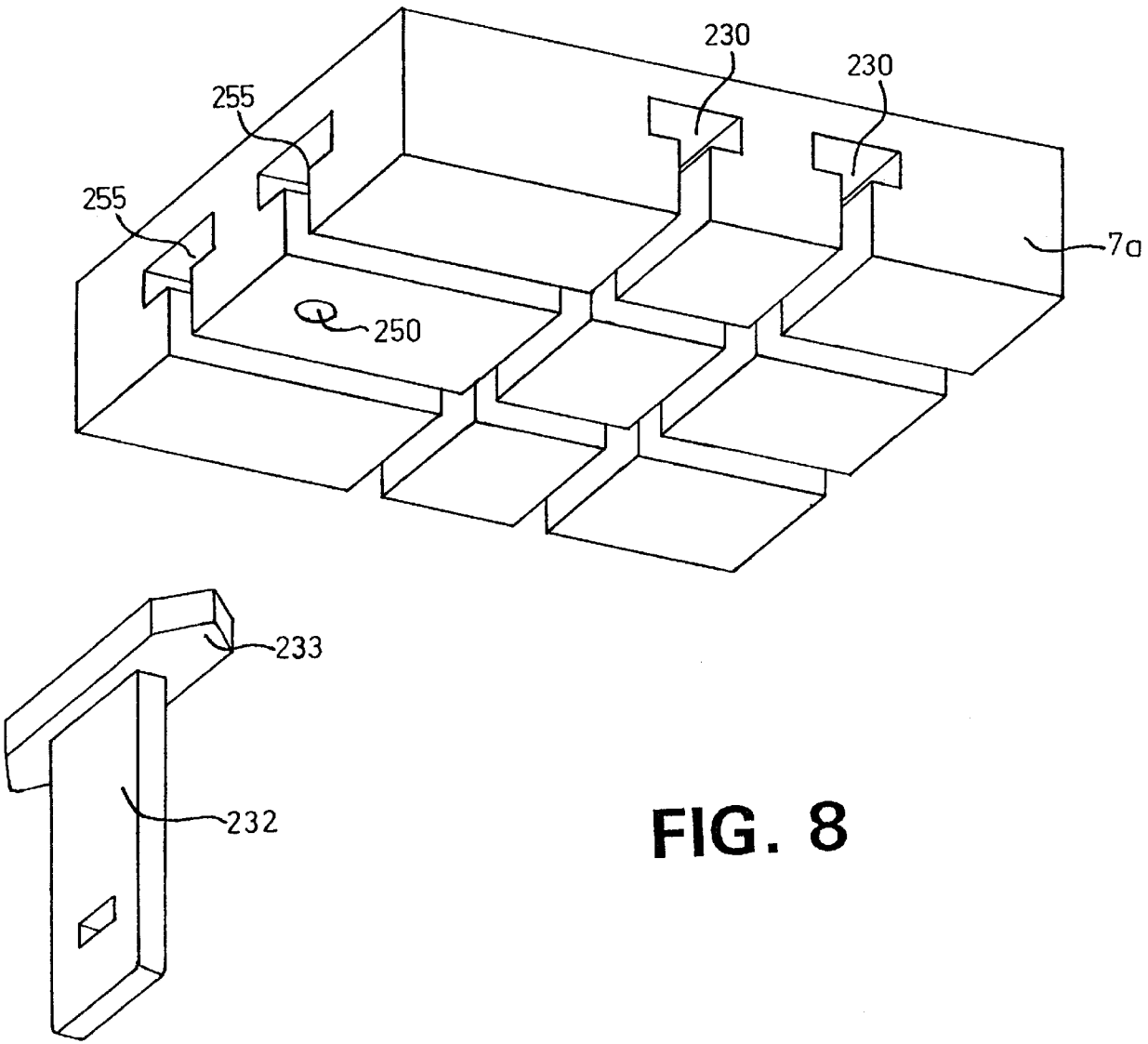
FIG. 8 is an illustration corresponding to FIG. 6 of the fastening base and the fastening member belonging to the fastening device as shown in FIG. 7.

FIG. 7 is an illustration corresponding to FIG. 4 of an alternative embodiment of the application of the fastening arrangement in accordance with the invention to the fastening of the roll 5 placed in the lower position in the first nip $N_1$ in the calender as shown in FIG. 1. As will come out from the following description, the sectional view of FIG. 7, which is a sectional view taken in the vertical plane in the machine direction of the roll fastening system, shows an arrangement in accordance with the invention which is preferable to that shown in FIG. 4. Further, FIG. 8 is a schematic perspective view corresponding to FIG. 6 of the fastening base and fastening member that are used in the fastening device shown in FIG. 7.

In the illustration of FIG. 7, similar to FIG. 4, a loading arm **8*a* comprises a box beam construction including a lower wall 261, an upper wall 263 having a lower face 264, and side walls (not shown in FIG. 7). The fastening system, which is arranged in the interior of the box beam construction, includes a shaft 238 arranged to extend through a hole formed in a fastening piece or member 270. Shaft 238 is suspended on a flange 239 which prevents the shaft 238 from moving in a downward direction in the illustration of FIG. 7, i.e., from passing completely through the member 270. Against the lower face of the fastening piece 270, a washer 237 is placed around the shaft 238. Further, a bushing 241 is arranged on the shaft 238, and onto this bushing, a spring assembly 234 consisting of at least one cup spring is installed. Underneath the spring assembly 234, i.e., at end of the bushing 241 opposite the washer 237, a transverse plate 235 is mounted. Plate 235 has an aperture through which the shaft 238 freely passes. At the opposite side of the plate 235 (the other side which does not engage with the spring assembly 234), a hollow cylinder 240 is installed. Cylinder 240 comprises a through axial hole through which the shaft 238 extends. In a manner similar to the embodiments described above, a threaded portion 242 is formed on the shaft 238 and a nut 243 is threaded onto this threaded portion. Nut 243** thus functions to hold the construction together.

As explained in the embodiments described above, the fastening arrangement further includes fastening members 232, which are, also in this embodiment, plate-shaped pieces and to whose ends T-section pieces 233 are formed, as described above. Through openings 231 are formed in the fastening piece 270 and through which openings 231, the fastening members 232 pass. Into the fastening members 232, openings 236 are formed, through which the transverse plate 235 arranged on the shaft 238 passes so that the fastening members 232 are suspended on the transverse plate 235. Similar to the embodiments described above, into the fastening base 7*a*, T-section grooves 230 corresponding to the shape of the T-section pieces 233 on the fastening members 232 are formed. The fastening members 232 are arranged in the grooves 230 as shown in FIG. 7. The T-section grooves 230 are placed in the transverse direction of the machine. In the embodiment of FIG. 7, similar T-section grooves 255 that extend in the machine direction are formed additionally in the fastening base 7*a*. The shape and location of the grooves 230,255 are shown in more detail in FIG. 8.

The embodiment shown in FIG. 7 differs essentially from the embodiment shown in FIG. 4 in the following manner. In order that both the T-section grooves 230 that extend in the transverse direction of the machine and the grooves 255 that extend in the machine direction, formed in the fastening base 7*a*, can be utilized, it is obvious that it must be possible to rotate the fastening members 232 from the position shown in FIG. 7 through a rotation of about 90°. This comes out from FIG. 7 clearly so that the fastening arrangement is installed by means of the shaft 238 on the fastening piece 270 and not directly on the box construction, which was the case in the preceding embodiments. To this end, in the upper wall 263 of the box construction, an opening is formed, which is shaped as a cone that becomes narrower in an upward directions. In a corresponding manner, the fastening piece 270 is shaped conical so that a conical face 272 of the opening in the upper wall 263 and a conical face 271 on the fastening piece 270 fit against each other. Thus, when the fastening base 7*a* has not been arranged in its correct position, the fastening piece 270 can be rotated around the axis of rotation passing through the shaft 238 to its proper position.

A cylinder part 273 is fixed to the fastening piece 270 and serves to enclose the fastening members 232, the spring assembly 234 and the hollow cylinder 240, with the related devices included in the fastening arrangement, within its cylindrical interior space. On the lower wall 261 of the box construction, underneath the cylinder part 273, a support ring 274 is fixed by means of screws 276 or equivalent fastening members. Support ring 274 prevents the fastening system from falling down when the fastening base 7*a* is not fitted in its correct position. In such a case, the cylinder part 273 rests on the support ring 274 whereby a top face 275 of the support ring 274 is formed as a bearing face. While being supported on this top face 275, the cylinder part 273 and, thus, also the fastening piece 270 with the related devices, can be rotated so that the fastening members become parallel to the T-section grooves 255 placed in the machine direction. The arrangement may further include stops (not shown) which limit the movement of rotation mentioned above to about 90° between the machine direction and the transverse direction.

In the embodiment of FIG. 7, the locating device also differs from the embodiments described above in that it comprises a cylinder 244 having a piston rod 245 and fixed to the lower wall 261 of the box beam construction, and a guide pin 246 mounted on the piston rod 245 of the cylinder. Correspondingly, a hole 250 is formed in the fastening base 7*a*, into which hole the guide pin 246 fits precisely. One end 247 of the guide pin 246 (opposite to that end mounted to the piston rod 245) is shaped conical in order that the guide pin 246 can penetrate into the hole 250 more readily to precisely position the fastening base 7*a* in its place.

In the embodiment of FIGS. 7 and 8, the installation of the roll into its position is carried out as follows. First, depending on whether the roll is installed into its position, for example, by means of a crane in the machine direction or, for example, by using a roll replacement carriage in the transverse direction of the machine, the fastening members 232 are rotated to the correct position while the cylinder part 273 rests on the bearing face 275 of the support ring 274. After this, the spring assembly 234 is pressed together by means of the cylinder 240, whereby the fastening members 232 are pushed into their upper position. Then, the piston 245 of the cylinder 244 of the locating device is pulled into its inner position. When the fastening members 232 are in their upper position, the fastening base 7*a* is fitted into its position on a back-up face 265 of the upper wall 263 so that the T-section grooves 230 or 255, respectively, in the fastening base 7*a* meet and engage with the T-section pieces 233 on the fastening members 232. Depending on the mode of installation, the roll is shifted either in the transverse direction or in the machine direction until it is in the desired location, after which at least some of the pressure can be released from the cylinder 240. After this, the piston rod 245 of the cylinder 244 of the locating device is pushed outward (upward) so that the conical end 247 of the guide pin 246 meets the hole 250 placed in the fastening base 7*a* and enters into the same. The conical end 247 of the guide pin 246 guides the fastening base 7*a* ultimately to its correct position so that the guide pin 246 can be finally pushed fully out into the position shown in FIG. 7. When the guide pin 246 has been pushed out fully, the pressure can be released completely from the cylinder 240, whereby the spring assembly 234 pulls the fastening members 232 down in the illustration of FIG. 7 and tightens the fastening base 7*a* tightly into its position into the desired position and also fixes the fastening piece 270 tightly into its position as the conical faces 271,272 are placed against each other. The removal of the roll 5 out of its position is carried out by performing the operations described above in the reverse sequence.

Above, the invention has been described by way of example with reference to the figures in the accompanying drawing. The invention is, however, not confined to the exemplifying embodiments shown in the figures alone, but various modifications are possible within the scope of the inventive idea. Thus, for example, in the figures in the drawing it is shown that the actuator or displacement means by whose means the roll is tightened into its position is a spring assembly 34,134,234 consisting of cup springs. Of course, it is obvious that, instead of a cup spring assembly, it is possible to use a spring of some other type, such as, for example, a spiral spring or equivalent. Also, as an actuator, instead of spring assembly 34,134,234, it is probably possible to use, for example, a wedge shoe or an equivalent device. However, at least at the present stage, spring assembly 34,134,234 appears to be the preferred embodiment in the device and method in accordance with the invention.

As the actuator means by whose means the tightening force produced by the spring assembly 34,134,234 is released, in the embodiments described above, a cylinder 40,140,240, in particular a hydraulic cylinder, is used. This is also the most advantageous mode of accomplishing the invention, but, of course, the tightening force of the spring assembly 34,134,234 can also be released in other ways. Further, in the exemplifying embodiments described above, the locating device of the arrangement in accordance with the invention has been accomplished by means of a hydraulic cylinder 44,144,244 and a wedge piece 46,146 or a guide pin 246. Instead of these members, it is also possible to use some other actuator or device by whose means the bearing housing 6,12 can be placed precisely in its correct position. The exemplifying embodiments described herein are, however, some of the most advantageous modes of carrying out the solution.

Further alternatives and embodiments of the invention may show variation within the scope of the inventive idea defined in the accompanying patent claims.

What is claimed is:

1. In combination with a paper machine having a frame including back-up faces and a roll including ends provided with a respective bearing a device for fastening the roll to the frame, said device comprising fastening members arranged on the frame, each of said fastening members including a flange portion and being displaceable in a direction substantially perpendicular to a respective one of said back-up faces, bearing housings on which one of said respective bearings is mounted, respectively, each of said bearing housings including at least one groove that receives said flange portion of a respective one of said fastening members such that upon reception of said flange portion in said at lest one groove, said respective fastening member is displaced in direction substantially perpendicular to said respective back-up face such that said flange portion is displaced toward said respective back-up face and thereby tightens a respective one of said bearing housings against said respective back-up face, displacement means coupled to each of said fastening members for displacing said fastening member in the substantially perpendicular direction toward said respective back-up face, actuator means coupled to said fastening means for moving each of said fastening members in a direction away from said back-up face two of said fastening members for each of said bearing housings, said fastening members having an aperture therein, and a plate for connecting said fastening members, said plate extending through said apertures and having an aperture therein, said actuator means comprising a shaft having a flange abutting against said bearing housing, said shaft extending through said aperture of said plate.

2. The device of claim 1, wherein said displacement means comprise at least one spring.

3. The device of claim 1, wherein said actuator means comprise a hydraulic cylinder.

4. The device of claim 1, wherein said displacement means comprise a spring assembly having cup springs.

5. The device of claim 1, further comprising means for pre-tightening said displacement means to provide a specific tightness such that said displacement means produce an adequate tightening force in the direction toward said back-up faces.

6. The device of claim 1, wherein said flange portions have a T-shape cross-section and said at least one groove in said bearing housings has a corresponding shape.

7. The device of claim 1, wherein said at least one groove in said bearing housings extends in a direction perpendicular to an axis of the roll.

8. The device of claim 1, wherein said at least one groove in said bearing housings extends in a direction parallel to an axis of the roll.

9. The device of claim 1, wherein the paper machine has a machine direction which is a direction in which a web is adapted to travel through the paper machine, said bearing housings comprising a plurality of grooves at least one of which extends in said machine direction and at least one of which extends in a direction transverse to said machine direction, said fastening members being rotatable around an axis substantially perpendicular to a respective one of said back-up faces such that said flange portions of said fastening members are receivable within a respective one of said machine direction or said transverse direction grooves.

10. The device of claim 1, further comprising positioning means for displacing each of said bearing housings in a direction parallel to a respective one of said back-up faces.

11. The device of claim 10, wherein said positioning means comprise a hydraulic cylinder-piston device having a wedge piece.

12. The device of claim 10, wherein said positioning means comprise a hydraulic cylinder-piston device having a guide pin, each of said bearing housings including an aperture, said guide pin being arranged to pass through a respective one of said apertures to precisely position said bearing housings and thus the roll.

13. The device of claim 1, wherein the displacement of said fastening members is controlled by remote-control via a control desk.

14. The device of claim 1, wherein said bearing housings comprise fastening bases formed thereon, said at least one groove being arranged in said fastening bases.

15. The device of claim 1, further comprising a rotatable member housing said displacement means and said actuator means such that upon rotation of said member, said flange portions are rotated, and support means fixed to the machine frame for supporting said rotatable member during rotation thereof.

16. Device for fastening a roll to a frame of a paper machine, the roll including ends provided with a respective bearing, the frame including back-up faces, the device comprising fastening members arranged on the frame, each of said fastening members having an aperture therein and including a flange portion and being displaceable in a direction substantially perpendicular to a respective one of said back-up faces, and bearing housings on which one of said respective bearings is mounted, respectively, each of said bearing housings including two grooves that receive said flange portion of two of said fastening members such that upon reception of said flange portion in said groove, said respective fastening member is displaced in a direction substantially perpendicular to said respective back-up face such that said flange portion is displaced toward said respective back-up face and thereby tightens a respective one of said bearing housings against said respective back-up face, displacement means coupled to each of said fastening members for displacing said fastening member in the substantially perpendicular direction toward said respective back-up face, a plate for connecting said two fastening members coupled to each of said bearing housings, said plate extending through said apertures in said two fastening members and having an aperture therein, and actuator means coupled to each of said fastening members for moving said fastening members in a direction away from said respective back-up face, said actuator means comprising a shaft having a flange abutting against said respective bearing housing, said shaft extending through said aperture of said plate.

* * * * *